United States Patent [19]

Hermes

[11] 4,406,368

[45] * Sep. 27, 1983

[54] DRAWING TOOL ORGANIZER

[76] Inventor: Glenn P. Hermes, 295 E. River, New Braunfels, Tex. 78130

[ * ] Notice: The portion of the term of this patent subsequent to May 4, 1996 has been disclaimed.

[21] Appl. No.: 328,425

[22] Filed: Dec. 7, 1981

Related U.S. Application Data

[63] Continuation-in-part of Ser. No. 85,026, Oct. 15, 1979, Pat. No. Des. 264,225.

[51] Int. Cl.[3] ..... A45C 11/34; B65D 85/28; B65D 69/00; B65D 6/04

[52] U.S. Cl. ..... 206/371; 206/214; 206/1.7; 206/483; 206/224; 206/558; 206/562; 220/23.4; 220/22.3; 220/7; 211/69.1

[58] Field of Search ..... 206/371, 214, 443, 1.7, 206/473, 483, 1.8, 224, 562, 561, 563, 558; 220/23.4, 23.2, 23.83, 23.86, 23.8, 22.3, 7; 211/7, 69.1; 108/64; D19/78

[56] References Cited

U.S. PATENT DOCUMENTS

| | | | |
|---|---|---|---|
| D. 146,470 | 3/1947 | Fresco | D19/78 |
| D. 173,818 | 1/1955 | Rogers | D19/78 |
| D. 226,139 | 1/1973 | Kimura | D19/78 |
| D. 239,334 | 3/1976 | Lowenstein | D19/77 |
| 1,579,978 | 4/1926 | Vincia | 211/69.1 |
| 2,088,953 | 8/1937 | Greer | 206/214 X |
| 3,327,688 | 6/1967 | Smith | 206/214 |
| 4,176,743 | 12/1979 | Fitzpatrick | 206/214 |
| 4,304,330 | 12/1981 | Winkler et al. | 206/214 |
| 4,318,471 | 3/1982 | Hutton | 206/214 |
| 4,320,835 | 3/1982 | Polhemus et al. | 206/214 X |

FOREIGN PATENT DOCUMENTS

| | | | |
|---|---|---|---|
| 2311728 | 7/1975 | France | 206/224 |
| 2381634 | 10/1978 | France | 206/214 |
| 4412 | of 1893 | United Kingdom | 206/214 |

*Primary Examiner*—Steven M. Pollard
*Assistant Examiner*—Bryon Gehman
*Attorney, Agent, or Firm*—Gale R. Peterson

[57] ABSTRACT

A drawing tool organizer comprising a plurality of units adapted to hold varied drawing tools, and connectors for releasably securing said plurality of units one to the other.

4 Claims, 3 Drawing Figures

DRAWING TOOL ORGANIZER

CROSS-REFERENCE TO RELATED APPLICATIONS

This is a continuation-in-part of Ser. No. 85,026, filed Oct. 15, 1979 now, U.S. Pat. No. D264225, issued May 4, 1982, for DRAFTING TABLE ORGANIZER by Glenn P. Hermes.

BACKGROUND OF THE INVENTION

The present invention relates to a drawing tool organizer, in particular a drawing tool organizer adapted to hold a variety of drawing tools in separate units which units may be releasably secured one to the other and clamped to a drawing table.

Drawing or drafting, of course, requires a wide variety of tools including numerous different pens and pencils, erasers, tape, templates, squares and triangles, bottles of ink and other drafting solutions, and many other implements too numerous to list herein. Drawing or drafting tables typically consist of a large slanted surface having few if any places to store or place the drawing tools. Because the drawing or drafting table is typically slanted, placing a pen, pencil or other implement on the table itself is impractical as the implement will simply roll or slide off. Occasionally trays or boxes are placed adjacent to the table, however, the drawing or drafting tools generally wind up in a clutter in such tray or box rendering efficient finding of a particular implement virtually possible. Moreover, drawing or drafting tools are typically sensitive, delicate instruments which are damaged or easily scarred by simply tossing such implements in a tray or box.

Consequently, the art has long needed an organizer capable of holding the wide variety of drawing tools needed in typical drafting operations, and to present those drawing tools in an arrangement and format such that their selection and use is efficient. Such an organizer must be capable of being releasably secured to a drafting table such that the tools are in a convenient place for use.

Additionally, differing drafting or drawing operations require different varieties of drafting tools. A single organizer having a place to store the whole variety of drawing or drafting tools available would result in an organizer covering a substantial portion of the drafting table and would be impractical.

Furthermore, different draftsmen prefer their tools located in different arrangements, and a single organizer containing set storage places would not satisfy those needs.

Numerous organizers and holders have been suggested in the past such as disclosed in U.S. Pat. No. D-165,645 to Fretz, Jr.; U.S. Pat. No. D-183,031 to Tarte, Jr.; U.S. Pat. No. D-183,053 to Lindemann et al.; U.S. Pat. No. D-202,393 to Wallerstein et al.; U.S. Pat. No. D-239,334 to Lowenstein; and U.S. Pat. No. D-184,610 to Doman. None, however, offer the unique features and advantages of the present invention, and, in particular, none provide a means for joining multiple units together wherein each unit is specially adapted to hold and display particular tools.

SUMMARY OF THE INVENTION

The present invention satisfies that long felt but unresolved need in the art by providing a drawing tool organizer having a variety of storage locations for the varied drawing tools needed during drafting operations.

The drawing tool organizer of the present invention furthermore provides a variety of individual units which may be arranged and used or not used at the discretion of the draftsman. Thus, a draftsman having use for only certain drawing tools is not forced to cover precious space on his or her drafting table with unnecessary holders.

The drawing tool organizer of the present invention furthermore allows a complete interchangeability of units such that an individual draftsman can arrange the units and consequently the drawing tools to suit his or her own personal style.

The drawing tool organizer of the present invention presents drawing tools in a convenient upright format allowing for simple, expedient selection and use of any desired tool.

Additionally, the various units of the drawing tool organizer according to the present invention may be releasably secured one to the other and clamped as an entire unit to a drawing or drafting table, thus obviating the problem of tools rolling or sliding off the table. Moreover, separate compartments are provided for each drawing or drafting tool thus precluding any injury or damage to the tools.

Therefore, it is a principal object of the present invention to provide a drawing tool organizer which allows convenient and expedient storage of drawing or drafting tools in a ready to use position.

It is furthermore an object of the present invention to provide a drawing tool organizer which can be releasably secured to a drafting table without interfering with the use of the drafting table.

It is a further object of the present invention to provide a drawing tool organizer consisting of a plurality of individual units adapted to hold a variety of drawing tools, such that the units may be positioned in a plurality of combinations to satisfy the needs of any particular draftsman.

It is yet a further object of the present invention to provide a drawing tool organizer which simply may be economically manufactured.

Other objects, features, and advantages of the invention will become evident in light of the following detailed description, viewed in conjunction with the referenced drawings, of a preferred drawing tool organizer according to the invention. The foregoing and following description of the invention is for exemplary purposes only. The true spirit and scope of the invention is set forth in the appended claims.

DETAILED DESCRIPTION

Figure 1:
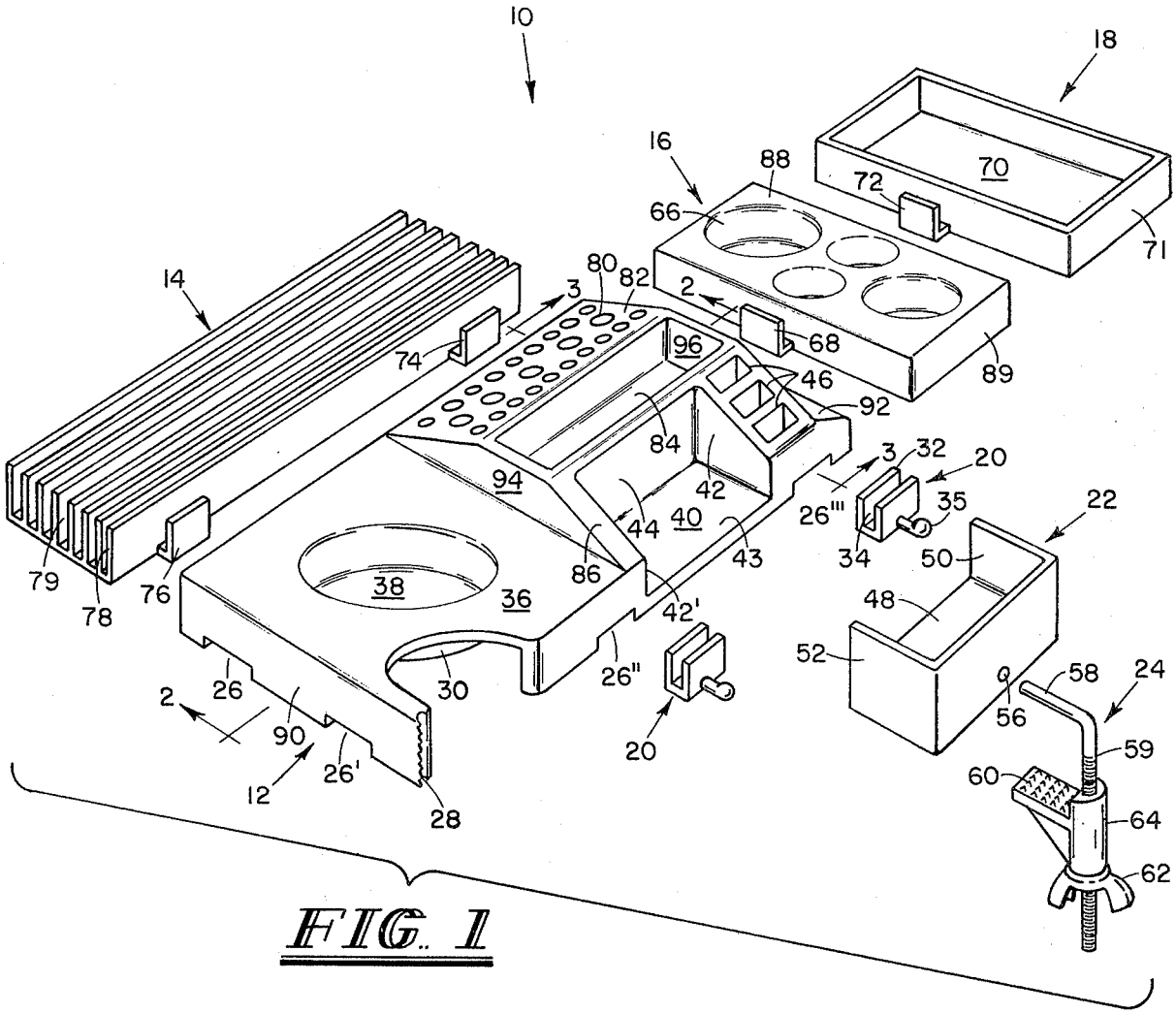
FIG. 1 is an exploded perspective of a drawing tool organizer according to the present invention.

Referring to FIG. 1, the drawing tool organizer 10 according to the present invention comprises a plurality of units 12, 14, 16, and 18 adapted to hold varied drawing tools and having connecting means, more fully described below, for releasably securing those units one to the other.

Figure 2:
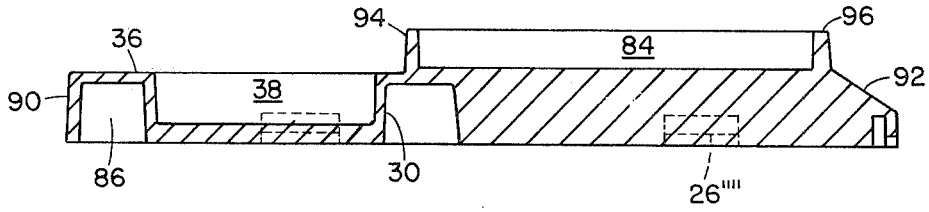
FIG. 2 is a cross-sectional view of a drawing tool organizer according to the present invention taken along lines 2—2 in FIG. 1.

Organizer unit 12 comprises an elevated wall member 90 defining a substantially rectangular polygon. A first substantially flat top surface 36 joins elevated wall member 90 at one edge and two sides of the substantially rectangular polygon defined by wall member 90, as shown in FIG. 1. Organizer unit 12 has a second top surface having opposed slanting surfaces 82 and 86 joining elevated wall member 90 at two sides of the substantially rectangular polygon formed by wall member 90, and a slanting surface 92, as shown in FIG. 2, joining elevated wall member 90 at the opposite edge of the substantially rectangular polygon formed by wall member 90 from the edge at which first top surface 36 joins elevated wall member 90.

A vertically extending wall member 94 joins first top surface 36 to the second top surface.

A plurality of cavities 80, 84 and 46 are formed in the second top surface of organizer unit 12 and are adapted to hold a variety of drawing tools. For example, apertures 80 are preferably formed of various sizes to hold a variety of differently sized drawing pens and pencils. Cavities 46 are sized to hold various erasers. A tray 84, defined by wall member 96, can be used to store a number of varied small drawing implements.

A clamping cavity 40 is formed in the second top surface of organizer unit 12, and in particular is formed in slanting surface 86. Clamping cavity 40 is formed from vertical wall members 42, 42', and 44 and base member 43. Vertical wall members 42, 42' and 44 extend downward from slanting surface 86. Clamping cavity 40 is contoured to circumscribe the base of a drafting tool pencil sharpener. In practice, drafting tool pencil sharpeners typically have a clamp attached thereto for securing the pencil sharpener to a drafting table. When used with the drawing tool organizer of the present invention, the base of such drafting tool pencil sharpener is placed in clamping cavity 40 and the clamp attached to the pencil sharpener used to clamp the drawing tool organizer of the present invention to the drafting table.

Alternatively, if a draftsman does not wish to mount a drafting pencil sharpener on the table, an auxiliary clamping means 22 may be used to secure organizer unit 12 to a drafting table. Auxiliary clamping means 22 comprises a three sided polygon having three elevated wall members 50, 52 and 54, and a base member 48. The three-sided polygon formed by wall members 50, 52 and 54, and base member 48 is adapted to mate with clamping activity 40 thus forming an additional tray to retain drawing tools.

A clamp 24 comprises an L-shaped latch member having one leg 58 adapted to fit through an aperture 56 formed in wall 54 of three-sided polygon 22 and having a threaded leg 59. A table gripping member 64 having a table gripping surface 60 is slidably disposed over threaded leg 59, and positioned by a wing nut 62 carried by threaded leg 59.

Thus, organizer unit 12 may be securely attached to a drafting table by disposing three-sided polygon 22 within clamping 40, inserting leg 58 of clamp 24 through aperture 56, sliding table gripping member 64 upward until table gripping surface 60 is in engagement with the lower surface of the drafting table, and tightening wing nut 62 until organizer unit 12 is securely fastened to a drafting table.

If it is desired not to clamp the organizer unit 12 to a drafting table, a flat rectangular plate having the same size as the underside of organizer unit 12 may be secured to the underside of unit 22 such that upon inserting unit 22 into cavity 40 the flat rectangular plate covers and encloses the bottom of unit 12. Doing so, of course, allows organizer unit 12, either alone or with the other units attached, to be readily moved about a desk or table.

A circular cavity 38 defined by a downwardly extending circular wall 30 is formed in first top surface 36. Circular wall 30 is adapted to fit within the center of a drafting tape roll, and allow the drafting tape roll to rotate thereon. As shown in FIG. 2, the tape roll would fit within circular cavity 86. As illustrated in FIG. 1, an opening is formed in elevated wall 90 adjacent circular cavity 38 and is adapted to allow access to the drafting tape roll disposed in cavity 86. A cutting bar 28 is mounted adjacent that opening and is adapted to permit the drafting tape to be cut or severed to appropriate lengths. Cavity 38 also provides a convenient storage location for varied implements, and in particular functions to hold standard drafting pencil lead cleaners.

The drawing tool organizer of the present invention also includes a template holder unit 14 adapted for holding a plurality of drafting templates in an upright position. Template holder unit 14 comprises a plurality of spaced upright members 78 forming a plurality of slots 79. Drafting templates come in a variety of thicknesses and it is therefore preferable to construct template holder 14 such that slots 79 have a variety of varying widths.

Numerous drawing tools are more easily accessible when hung on a hook or a hanger as opposed to lying in a receptical. Therefore, the drawing tool organizer of the present invention also includes a hook or hanger device 20 having a hook or hanger 35 secured to a U-shaped bracket consisting of upright legs 32 and base member 34. The U-shaped bracket is adapted to fit within any one of notches 26, 26',26'', 26''', or 26'''' with upright legs 32 then being disposed on either side of elevated wall member 90. When organizer unit 12 is securely clamped to a drawing table, hook unit 20 will remain securely locked in notches 26, 26', 26'', 26''', or 26''''.

The drawing tool organizer of the present invention also includes a tray unit 18 comprising an elevated wall member 71 defining a substantially rectangularly shaped polygonal cavity 70. Tray unit 18 may be used to store a variety of miscellaneous drawing or other tools, or other items which would otherwise roll or slide off the slanted surface of a drafting table.

Additionally, the drawing tool organizer of the present invention includes a bottle unit 16 comprising an elevated wall member 89 defining a substantially rectangular polygon, and having a substantially flat top surface 88. A plurality of cavities 66 are formed therein and are adapted to circumscribe drawing ink or other drafting solution bottles, thus allowing ready access to the same.

Thus, as aforesaid and as a principal advantage of the present invention, multiple units 12, 14, 16, 18 and 20 provide a complete array of holders for a variety of drawing tools. A particularly unique feature of the present invention, however, is the ability to releasably secure those multiple units together in a number of different combinations and clamp the combined unit as a whole to a drafting table using a single clamp, such as the auxiliary clamping means 22 and 24 or a standard clamp-type drafting pencil sharpener.

Figure 3:
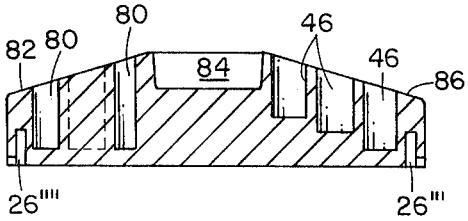
FIG. 3 is a cross-sectional view of a drawing tool organizer according to the present invention taken along line 3—3 in FIG. 1.

In order to releasably secure the multiple units together, a multiple unit connecting means is provided. As most clearly shown in FIG. 1 and FIG. 3, a plurality of notches 26, 26', 26'', 26''', and 26'''' are formed in the lower edge of elevated wall member 90. Cooperating L-shaped connecting members, such as connecting members 76 and 74 on template holder unit 14 are adapted to fit within notches 26, 26', 26'', 26''', and 26'''' and securely lock units 14, 16, and 18 to organizer unit 12. In order to allow complete flexability in arranging the combination of units, the spacing of notches 26, 26', 26''', and 26'''' is chosen to allow units 14, 16, and 18 to be secured to organizer unit 12 at any location. In that regard, bottle unit 16 has a single L-shaped connecting member 68 and tray unit 18 has a single L-shaped connecting member 72. The size of units 16 and 18 is preferably chosen such that units 16 and 18 may be placed end to end with the spacing between L-shaped connecting members 68 and 72 equalling the spacing between L-shaped connecting members 76 and 74 on template holder unit 14. On the ends of organizer unit 12, units 16 and 18 may be secured in either notch 26 or 26'.

Hook units 20, of course, may be disposed at any location around organizer unit 12.

In order to further provide flexability to the drawing table organizer of the present invention, notches similar to 26 are formed on template holder unit 14, tray unit 18, and bottle unit 16 on the opposite sides of the attachments for the L-shaped connecting members. Therefore, units 14, 16, and 18 may be "stacked" behind each other, or units 16 and 18 disposed end to end on the side of template holder 14 opposite to L-shaped connecting members 76 and 74.

The drawing tool organizer of the present invention may be constructed of any suitable material. However, an easily formable material such as plastic is preferred. The L-shaped connecting members, such as members 76 and 74 may either be formed integrally with the respective units or attached after the units are formed. An alternative to using L-shaped connecting members attached to the individual units is to form notches, such as notches 26, in all of the units and provide U-shaped connecting members, such as the U-shaped connecting member of hook unit 20 to securely attach the units together.

Indeed, although the foregoing cooperating notches and connecting members are the presently preferred multiple unit connecting means for the drawing tool organizer of the present invention, many other alternatives and variations, within the scope of the present invention, will be apparent to those of ordinary skill in the art.

Therefore, the present invention provides an easily manufactured drawing tool organizer which allows convenient and expedient storage of drawing or drafting tools in a ready-to-use position and which can be releasably secured to a drafting table without interferring with the use of the drafting table. The present invention furthermore provides a drawing tool organizer consisting of a plurality of individual units adapted to hold a variety of drawing tools, which units may be positioned in a plurality of locked-together positions to satisfy the needs of a particular draftsman.

Although the invention has been described in conjunction with the foregoing specific embodiment, many alternatives, variations and modifications will be apparent to those of ordinary skill in the art. Those alternatives, variations, and modifications are intended to fall within the spirit and scope of the appended claims.

I claim:

1. A drawing tool organizer comprising:

an organizer unit comprising an elevated wall member defining a substantially rectangular polygon, a first substantially flat top surface joining said elevated wall member at one edge and two sides of said substantially rectangular polygon, a second top surface having opposed slanting surfaces joining said elevated wall member at two sides of said substantially rectangular polygon and a slanting surface joining said elevated wall member at the opposite edge of said substantially rectangular polygon from the edge at which said first top surface joins said elevated wall member;

a vertically extending wall member joining said first and second top surfaces;

a plurality of cavities formed in said second top surface adapted to hold a variety of drawing tools;

a clamping cavity formed in said second top surface having vertical wall members defining said clamping cavity extending downward from one of said two opposed slanting surfaces and contoured to circumscribe the base of a drafting tool pencil sharpener having a table clamp attached thereto;

a circular cavity formed in said first top surface having a downwardly extending circular wall defining said circular cavity wherein said circular wall is adapted to fit within the center of a drafting tape roll;

an opening formed in said elevated wall adjacent said circular cavity adapted to allow access to said drafting tape roll;

cutting means mounted adjacent said opening adapted to permit cutting of said drafting tape;

a template holder unit adapted for holding a plurality of drafting templates in an upright position;

at least one hook unit adapted for hanging drafting tools therefrom;

a tray unit comprising an elevated wall member defining a substantially rectangularly shaped polygonal cavity;

a bottle unit comprising an elevated wall member defining a substantially rectangular polygon, and a substantially flat top surface having a plurality of cavities formed therein adapted to circumscribe drafting solution bottles;

multiple unit connecting means for releasably securing said organizer unit, said template holder unit, said at least one hook unit, said tray unit, and said bottle unit comprising a plurality of notches formed in the lower edge of said elevated wall member of said organizer unit and adapted to mate with L-shaped connecting members attached to said template unit, said tray unit, and said bottle unit, and adapted to mate with a U-shaped connecting member attached to said at least one hook unit; and auxiliary clamping means for securing said organizer unit to a drafting table comprising a three-sided polygon having three elevated wall members and a base member adapted to mate with said clamping cavity, an aperture formed in one wall member thereof, and a clamp comprising an L-shaped latch member wherein one leg of said latch member is adapted to fit through said aperture and the other leg of which is threaded and wherein a table gripping member is slidably positioned over said threaded leg and held in position by a nut carried by said threaded leg;

whereby said organizer unit, said template holder unit, said at least one hook unit, said tray unit, and said bottle unit may be joined together by disposing said notches on said organizer unit in said L-shaped connecting members and said U-shaped connecting members and securing said organizer unit to a flat surface.

2. A drawing tool organizer as in claim 1 further comprising:

a plurality of notches formed on said template holder unit, said tray unit, and said bottle unit opposite the attachment points for said L-shaped connecting members, whereby said template holder unit, said tray unit, and said bottle unit may be attached one to the other.

3. A drawing tool organizer unit comprising:

an elevated wall member defining a substantially rectangular polygon, a first substantially flat top surface joining said elevated wall member at one edge and two sides of said substantially rectangular polygon, a second top surface having opposed slanting surfaces joining said elevated wall member at two sides of said substantially rectangular polygon and a slanting surface joining said elevated wall member at the opposite edge of said substantially rectangular polygon from the edge at which said first top surface joins said elevated wall member;

a vertically extending wall member joining said first and second top surfaces;

a plurality of cavities formed in said second top surface adapted to hold a variety of drawing tools;

a clamping cavity formed in said second top surface having vertical wall members defining said clamping cavity extending downward from one of said two opposed slanting surfaces and contoured to circumscribe the base of a drafting tool pencil sharpener having a table clamp attached thereto;

a circular cavity formed in said first top surface having a downwardly extending circular wall defining said circular cavity wherein said circular wall is adapted to fit within the center of the drafing tape roll;

an opening formed in said elevated wall adjacent said circular cavity adapted to allow access to said drafting table roll; and cutting means mounted adjacent said opening adapted to permit cutting of said drafting tape.

4. A drawing tool organizer unit comprising:

an elevated wall member defining a polygon;

a first top surface joining said elevated wall member and having a circular cavity formed therein wherein said circular cavity is adapted to fit within the center of a drafting tape roll;

an opening formed in said elevated wall adjacent said circular cavity and adapted to allow access to said drafting tape roll;

a second top surface joining said first top surface and said elevated wall member having a plurality of cavities formed therein adapted to hold a variety of drawing tools; and means for releasably securing said drawing tool organizer unit to a drafting table top.

* * * * *